United States Patent [19]

Wetmore

[11] 4,422,803

[45] Dec. 27, 1983

[54] STACKED CONCRETE MARINE STRUCTURE

[75] Inventor: Sherman B. Wetmore, Westminster, Calif.

[73] Assignee: Global Marin, Inc., Los Angeles, Calif.

[21] Appl. No.: 325,778

[22] Filed: Nov. 30, 1981

[51] Int. Cl.[3] ..... E02R 17/00

[52] U.S. Cl. ..... 405/204; 405/207; 405/210; 405/211

[58] Field of Search ..... 405/203, 204, 210, 252, 405/205, 207, 211; 52/167, 285, 726; 114/65 A, 256, 257

[56] References Cited

U.S. PATENT DOCUMENTS

| | | | |
|---|---|---|---|
| 3,833,035 | 9/1974 | Yee | 114/65 A X |
| 3,913,335 | 10/1975 | Heien | 405/210 |
| 3,974,789 | 8/1976 | DeGroot | 114/256 |
| 4,106,301 | 8/1978 | Gerwick | 52/167 X |
| 4,155,671 | 5/1979 | Vos | 405/203 |
| 4,188,157 | 2/1980 | Vigander | 405/210 |

*Primary Examiner*—David H. Corbin

*Attorney, Agent, or Firm*—Christie, Parker & Hale

[57] ABSTRACT

A concrete offshore structure located in a body of water of selected depth and extending from a bed defining the bottom of the water body to above the water surface comprises at least two similar prefabricated concrete modular subassemblies interconnected in a vertical arrangement in such manner to define a horizontal interface between each such pair of subassemblies. vertically disposed shear resistant pin means between the subassemblies and cement at the interface secure them together.

A method for deploying such a structure includes towing the subassemblies offshore, mating them, and towing the assembled structure to the selected offshore installation site.

13 Claims, 25 Drawing Figures

STACKED CONCRETE MARINE STRUCTURE

FIELD OF THE INVENTION

This invention pertains to offshore fabricated structures. In particular, an offshore structure is provided which comprises at least two similar prefabricated concrete modular subassemblies connected vertically, along with a method for deploying such structure.

BACKGROUND OF THE INVENTION

There is current interest in oil and mineral exploration on the continental shelf. The evidence suggests that there are vast untapped reserves of oil under many continental shelf regions, for example off the coast of Mexico.

There are several logistical problems attendant to the development of offshore petroleum reserves. Once the oil has been drilled, the immediate problem is getting the oil to shore, where it can be used. Loading oil from the drillsite directly into tankers is one solution. This would involve intermittent shut down of petroleum extraction when the storage tanks at the drilling facility become filled to capacity; also the hazard of ship-to-facility collisions could interrupt operation. Moreover, for high volume operations, it is advantageous to operate continuously. For this reason, it is desirable to pump the oil initially into a large volume storage facility where it can be safely held for later transfer into supertankers.

A large volume storage facility would be desirable for offshore petroleum exploration. By allowing for continuous drilling operations it would obviate shipping scheduling problems. A storage facility also would hold and protect the oil during periods of hurricanes or heavy weather, when transfer of oil onto ships would be hazardous. Finally, a storage facility can provide usable above-water space for a wide variety of purposes, functioning in effect as a parcel of real estate in marine environment.

Constructing and deploying a large volume storage structure is difficult. The lack of available real estate in the ocean and the dynamic nature of the ocean environment makes it imperative that such a structure be prefabricated on land and towed out to sea. One major problem in constructing a large volume floating structure is to assure sufficient draft along the waterway to permit towing of the structure to the installation site. Many proposed oil exploration areas have good, flat, sandy bottoms, but at depths of up to about 65 feet. Seasonal hurricane or other storm waves make it desirable to maintain a deck height above water of at least 25 feet. Thus a major problem is one of building structures which are towable yet which have a 25 foot deck height for sites which may be on the order of 60 feet deep.

While it is possible to construct a single 90 foot high facility, the draft of such a structure limits the building sites to those with sufficient deepwater access. In this regard, there are few dredged harbors which exceed even a 38 foot depth and natural harbors are generally more shallow. Hence, towing of a 90 foot high concrete structure offshore would necessitate deep dredging of any given harbor area. Such an approach would be prohibitively expensive.

Assuming, however, that an appropriate structure could be fabricated onshore and deployed offshore, there are additional problems. Due to its high cost, it is desirable that any structure be fabricated of materials which will not corrode or weather in a marine environment. Moreover, if the facility is to be used for storing large volumes of oil or other flammable liquids, it is imperative that the risk of fire or explosion be reduced to a minimum. Furthermore, the structure should be designed, if possible, to accommodate internal breakage or failure so as to minimize the risk of a large scale oil spill.

There is need for a large volume storage structure which can be built economically with a "towable" draft and having a "weatherproof" deck height for a moderately deep installation. The need extends to a structure which is self-contained, strong, durable, lightweight and which has a long useful life. Finally, the need extends to a procedure for deploying such a structure from an onshore fabrication site.

SUMMARY OF THE INVENTION

To satisfy the above needs, this invention provides both a concrete offshore structure and a procedure for assembling and deploying it. When deployed, the concrete offshore structure is located in water of selected depth and extends from a surface defining the bottom of the water body to above the water surface.

The structure comprises at least two similar prefabricated concrete modular subassemblies interconnected in a vertical arrangement in such manner to define a horizontal interface between each such pair of subassemblies. Vertically disposed shear resistant pin means secured between each such pair of subassemblies at spaced locations of each interface and cement between each such pair at each interface secure the members of each pair together.

Preferably each subassembly defines at least one liquid storage tank with stored liquid and water piping means to each tank being arranged for supplying stored liquid and water to the tanks to maintain selected tanks filled with liquid. Preferably the interior of each subassembly has a honeycomb construction with vertical parallel cylinders interconnected by vertical shear walls.

If desired, the honeycomb construction may be fabricated in accord with the teachings of U.S. Pat. No. 3,833,035, issued Sept. 3, 1974 to A. A. Yee for "Floating or Submerged Marine Vessel for Storage, Support or Transport".

In terms of method, a pair of prefabricated subassemblies are floated in a body of water which has access to the selected place for deployment of the structure. One member of the subassembly pair is floated to a designated assembly site where it is ballasted to submerge it until it contacts the seabed. The other subassembly is positioned over the first one and ballasted to lower it proximate to the submerged subassembly. A plurality of rigid shear resistant pin means are then disposed between the subassemblies to bring them into essentially vertical alignment. The upper subassembly is further ballasted to contact the subassemblies along essentially all of their horizontal interface.

The mated subassemblies are then deballasted to bring the horizontal interface above the surface of the water while maintaining contact of the subassemblies along the interface. The subassemblies are then secured together with cement to form a unitary vertically stacked structure.

The structure may then be towed floating to a desired deployment site and ballasted to anchor it to the seabed at the site. Once in place, the structure may be filled with useful fluid by displacing the ballast water as needed to keep the interior storage volume full.

DESCRIPTION OF THE DRAWINGS

The invention may be better understood by referring to the accompanying drawings in conjunction with the following description of the presently preferred best mode of practice:

FIGS. 9–25 are simplified elevation views depicting deployment of the stacked offshore structure of FIG. 1, starting with fabrication of modular subassemblies at the construction site of FIG. 8 and continuing step by step with mating of the subassemblies offshore to form the stacked structure and continuing to installation at the desired offshore site, wherein:

FIG. 9 depicts a pair of completed modular subassemblies on an upper plateau of the construction site which is adjacent to an access channel of water;

FIG. 10 depicts flooding of the construction site to the level of the access channel;

FIG. 11 depicts continued flooding of the construction site to float the tanks;

FIG. 12 depicts movement of the tanks into a lower basin of the construction site with final preparations for launching;

FIG. 13 depicts breaching of the outside perimeter of the construction site and towing of the tanks into the access channel;

FIG. 14 depicts reestablishment of the outside perimeter of the construction site in preparation for constructing additional modular subassemblies;

FIG. 15 depicts towing of the lower modular subassembly to a designated site for mating of the subassemblies;

FIG. 16 depicts ballasting of the lower module to a selected draft level at the mating site;

FIG. 17 depicts ballasting of the forward compartment of the module and contact with the seabed at the mating site;

FIG. 18 depicts flooding of the aft compartment of the module and bottom contact with the bed;

FIG. 19 depicts positioning of the upper modular subassembly partially ballasted over the lower subassembly;

FIG. 20 depicts alignment and mating of the ballasted subassemblies to generate a vertically stacked structure;

FIG. 21 depicts deballasting of the structure to float it;

FIG. 22 depicts towing of the structure from the mating site to a selected deployment site;

FIG. 23 depicts positioning and ballasting of the structure at the selected site;

FIG. 24 depicts contact of the structure with the ocean floor; and

FIG. 25 depicts the structure in place at the selected installation site ready for on-line operation, as in FIG. 1.

DETAILED DESCRIPTION

Figure 1:
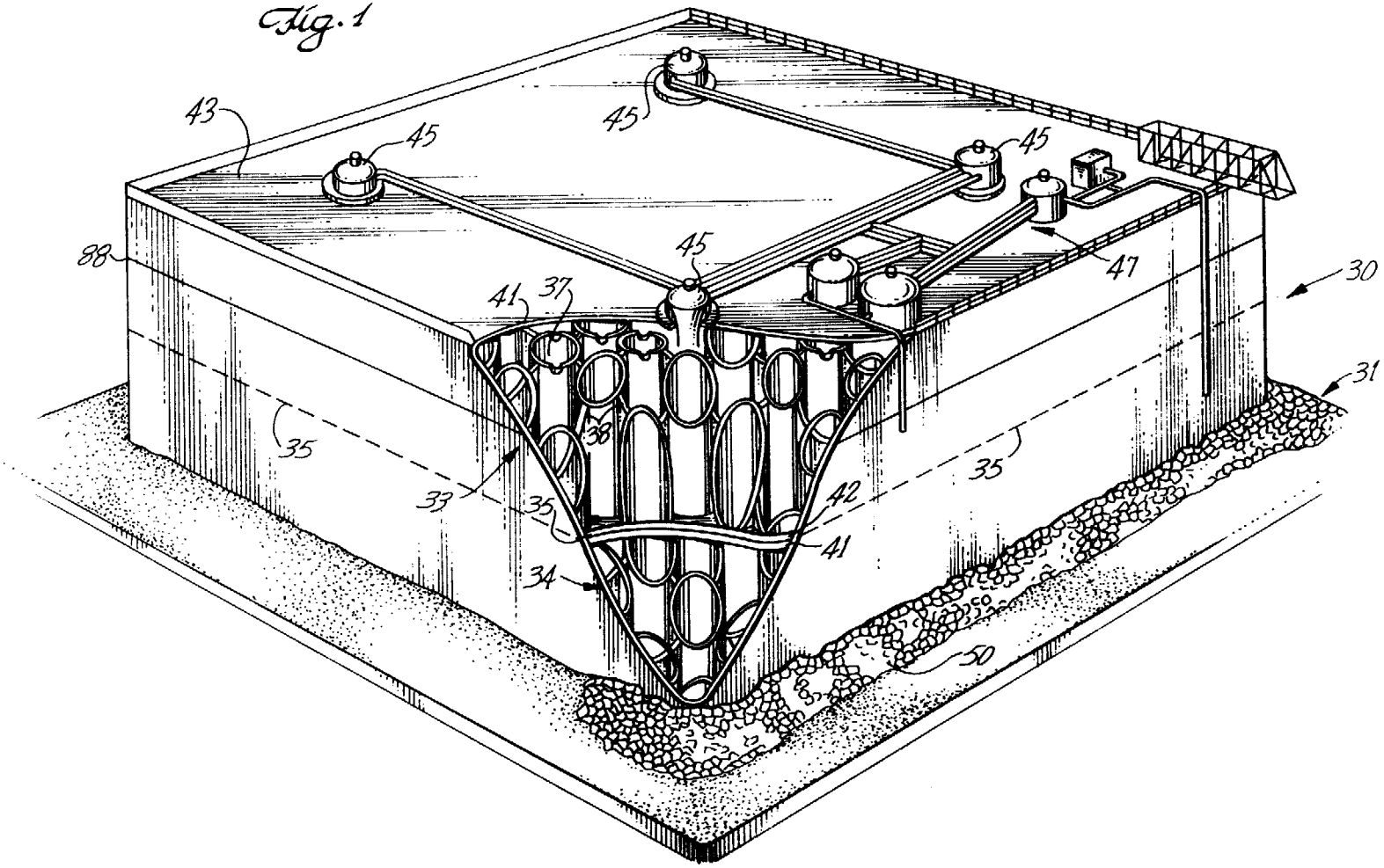
FIG. 1 is a perspective view of a stacked offshore structure comprising two vertically stacked modular subassemblies, according to this invention.
Figure 2:
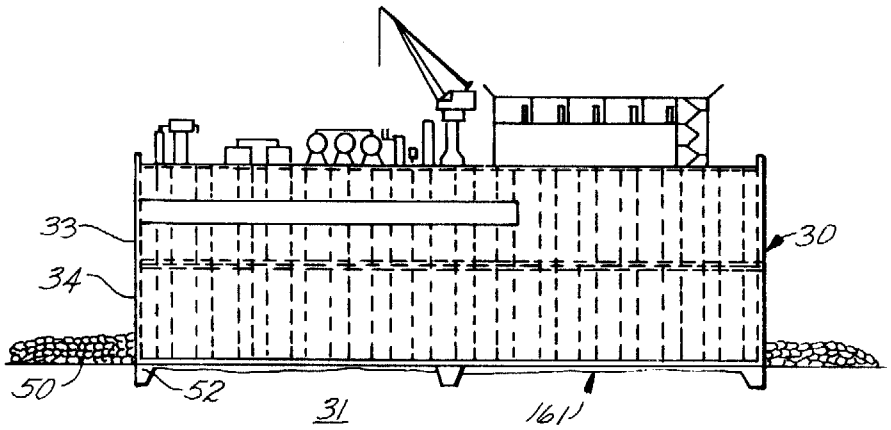
FIG. 2 is a side elevation view of the structure of FIG. 1.

FIG. 1 is a perspective of a stacked offshore structure 30 in place at a deep water site 31. The structure has a sandwich construction with an upper module 33 subassembly secured to a lower module 34 subassembly in a vertical relationship to define a horizontal interface 35.

The basic modular subassembly can generally be described as a concrete, post tensioned, honeycomb structure. As can be seen from the cutaway portion of FIG. 1, the modules have an internal honeycomb construction with vertical cylinders 37 interconnected by shear walls 38. The major structural elements in each module are the top and bottom slabs 41 and 42 which, during fabrication, are cast in place and post tensioned, and the precast reinforced concrete honeycomb cylinders 37 and shear walls 38. The horizontal interface 35 is formed by joining the bottom slab of the upper module to the top slab of the lower module, while the top slab 41 of the upper module serves as the top deck 43 of the overall facility. On the deck can be seen the top of four access trunks 45 which depend into the structure in four selected cylinders. The function of the access trunks will be described in more detail below.

The modules are preferably substantially the same size, although this is not required. However, as will become apparent, for a two-component stacked structure of a given volume, which is the simplest form of this invention, modules of equivalent dimension minimize the draft needed for towing of subassemblies offshore to a designated location for vertical assembly.

The top and bottom slabs are post tensioned to impart precompression to the structure and act as the top and bottom flanges of a massive beam. The concrete honeycomb cylinders function as the web of the beam and provide space for storing fluids. The completed assembly, fabricated from concrete, has a light yet exceedingly strong structure. It is capable of resisting large bending loads associated with towing and emplacement, and storm wave loading, including high unit pressure loading from hydrostatic forces. The arch-type structure in the vertical direction is well suited to resisting horizontal wave forces and in turn transmitting these forces into the top and bottom walls. For the two faces of the structure that are exposed to the maximum storm waves, the outer half cylinders and adjacent voids are filled with stabilized sand 61 (see FIG. 3) to add localized mass to increase the resistance to crushing. Such reinforcing enables the inboard side of the outermost cylinders to react impulsive loads into the overall structure.

A presently preferred exemplary structure is capable of accommodating pressure loading of about 30,000 $kg/m^2$ with the top and bottom slabs being post tensioned to impart an average 830 $kN/m^2$ precompression to the concrete. The side walls are made 400 milimeters thick and the other row of half cylinders (200 mm) are heavily reinforced with steel bars. The inner rows of cylinders have a diameter of about 4.6 m with thinner walls of 130 mm. The top and bottom walls 41, 42 of the upper module are about 300 mm and 316 mm thick, respectively, while on the lower modules these are about 360 mm and about 400 mm thick, respectively. All four slabs are heavily reinforced in all directions with prestressing tendons running in both the transverse and longitudinal directions. The tendons are run through precast ducts and, after post tensioning, are grouted in place to "lock-in" the prestressed load uniformly across the slab. This effective precompression stress is applied to insure that the concrete experiences essentially zero tension.

The basic modular subassembly 33,34 of the presently prefered examplary embodiment has a square configuration approximately 300 feet on each side and 45 feet high. Each module 33,34 has an oil storage capacity of about 550,000 bbls of oil with a 1.2 meter minimum allowance at the bottom for the interface between oil and seawater.

Operationally, the modules are kept full of liquid at all times. The modules are originally filled with seawater. When the facility is put on line, oil or other useful fluid (normally less dense than seawater) is pumped into the honeycomb cylinders to force seawater out the bottom of the cylinders eventually to overboard discharges. Conversely, when it is time to load oil on cargo vessels, seawater is pumped into the cylinders to force oil out to shipping pumps located on the deck of the structure.

Each module 33,34 contains an individual seawater ballasting and oil shipping system with seawater inlets, optional water treatment facilities and oil shipping pumps. These are mounted on the top deck 43, and are shown in FIG. 1 schematically at 47.

Figure 4:
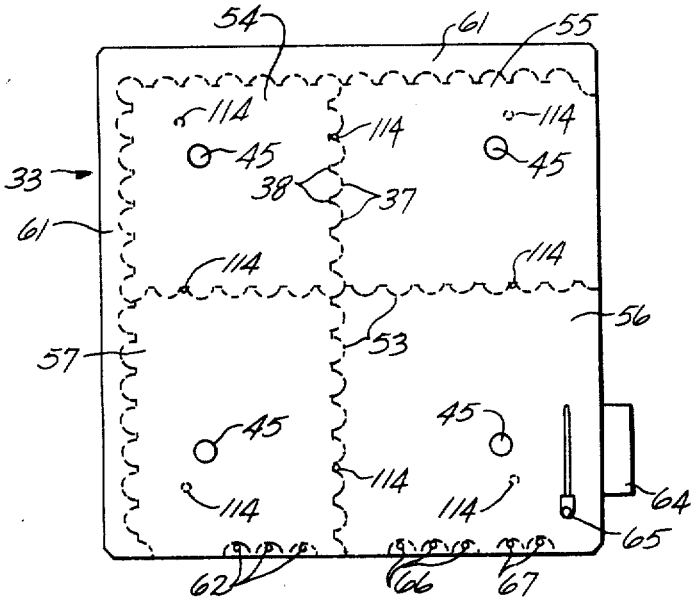
FIG. 4 is a plan view of the structure taken along the lines 4—4 of FIG. 3.

Both upper and lower modules are divided into four internal compartments 54–57, depicted in FIG. 4. These are separated by an internal tank boundary 53 formed by cylinders 37 and the shear walls 38 interconnecting them. In each compartment is an access trunk 45 which is not used for storing fluids but instead serves as a "free" space for running the ballasting and shipping piping 59 from appropriate manifolds located on the deck to the storage areas inside the various compartments.

Figure 3:
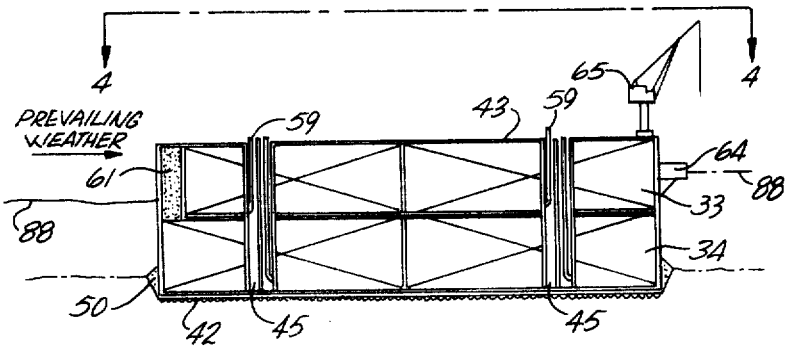
FIG. 3 is a simplified cross-sectional elevation view of the structure of FIG. 1.

In FIG. 3, two access trunks 45 are depicted with a portion of the piping 59 used for pumping oil and ballast fluid into and out of the compartments of the stacked structure. The access trunks run from the bottom slab 42 through both modules clear through top deck 43. The access trunks do not penetrate the lower slab but rather form a watertight seal with it.

Along those edges of the stacked structure which face the prevailing storms or heavy weather which are expected at the installation site, the outermost cylinders of the upper module are filled with an inert material, preferably sand, at reference numeral 61. The lower module need not be similarly reinforced as, under expected conditions, it is completely submerged under waterline 88.

In the outermost cylinders of those walls in the upper module which face the lee side of the weather, are a series of riser pipes 62, deep well saltwater ballast pumps 66 and overboard discharge pipes 67. Also located on the lee side are a boatdock 64 and a crane 65.

Figure 6:
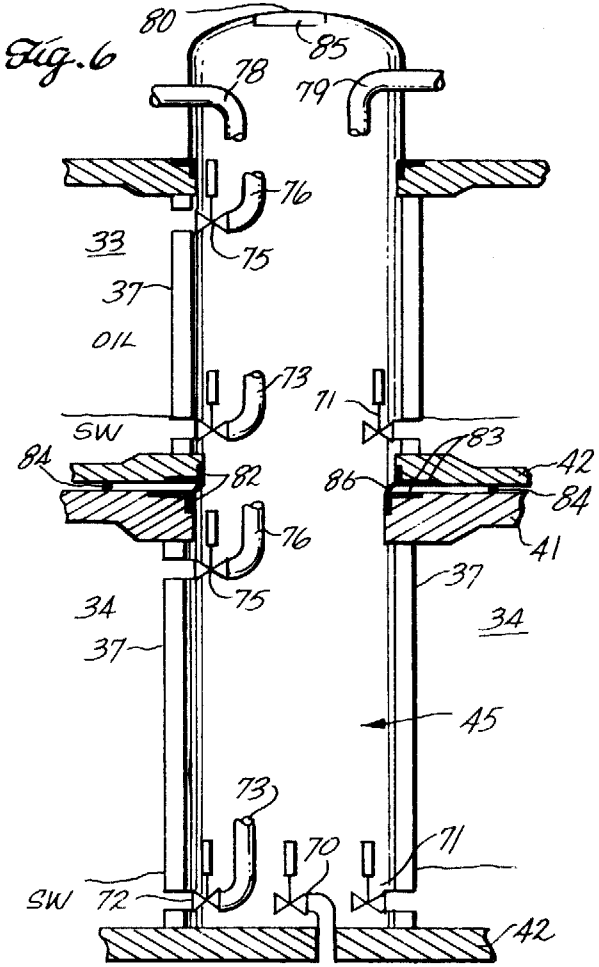
FIG. 6 is a schematic cross-sectional elevation view of an access trunk used in the structure.

The four internal compartments 54–57 in each module are kept hydraulically separate from each other by an internal tank boundary 53. Each compartment is operated through its own plumbing system which supplies seawater ballast and oil to the honeycomb storage cylinders. The piping for each internal compartment is centralized from its associated access trunk 45, which is located centrally of its respective internal compartment. In FIG. 6, a typical access trunk is depicted schematically with the major elements of such a piping system. In normal operation the access trunk is not filled with fluid but is purposefully kept dry. Preferably the trunk is filled with a dry inert nitrogen atmosphere to reduce hazards of spark or explosion.

At the bottom of the access trunk is a sea valve and discharge pipe 70 which penetrate the bottom slab 42. This valve permits drainage of fluid from the access trunk, and conversely, complete ballasting of the lower module in preparation for mating of the modules.

At the lower end of each module leading into the access trunk there is a trunk drain valve 71 having a blanking flange. This valve permits draining of fluids from the interstices of the internal compartment directly into the access trunk. It is used for deballasting of the facility after the modules have been mated. Also, once the stacked structure is on line, it is possible that collisions from ocean vessels, or other catastrophes such as earthquakes, etc., may cause internal damage to or breakage of fluid-containing cylinders 37. The tank drain valves provide a means to control any internal spillage by directing it into the access trunks. The problem can then be addressed by pumping the trunk dry and effecting field repairs. In the unlikely event of breakage of one of the internal tank boundaries 53, the affected compartments can be drained via the tank drain valves as needed for on site repairs. In the presently preferred embodiment, each tank drain valve 71 has an effective diameter of about 8 inches.

Each access trunk contains separate piping systems for seawater and oil or other useful fluids for both the upper and lower modules. At the base of the access trunk is located a sea water valve 72 controlling fluid flow through sea water ballast line 73 which is connected to a sea water line 79 at the top of the access trunk. There is a similar arrangement at the base of the upper module 33. Each of the pair of seawater ballast lines 73 leads to its own seawater line 79. In FIG. 6, only one of the sea water lines 79 is shown for purposes of clarity.

At the upper end of the lower module, an oil valve 75 controls fluid flow through oil line 76 which is in communication with an oil line 78 at the top of the access trunk. As with the sea water lines, there is a second oil line 76 at the upper part of the upper module corresponding to the oil line from the lower module, and a second oil line 78. The oil lines 78 lead from the access trunks through conventional pumping equipment to the riser pipes 62 which connect the storage facility with an oil producing platform or the like. The sea water lines 79 from the access trunks lead to the salt water ballast pumps 66 and overboard discharges 67.

The seawater lines 73 and oil lines 76 are in communication with the honeycomb cylinders and interstitial spaces. The piping for this may be run through the interstices between the shear walls and the cylinders, although other arrangements are possible.

For fabricating the access trunks in the presently preferred exemplary embodiment, a rolled ring 82 about 1½ inches thick, 6 inches high, with a 1 foot horizontal flange 83 is fabricated and cast into the inner surfaces of the selected four cylinders 37 which serve as the channels for the access trunks in each module. The rolled ring is suitably reinforced to become integral with the top and bottom slabs of the module. A flexible seal 84 made of neoprene or the like and having an O-ring configuration is placed on the deck of the lower module before mating of the modules, and glued in place. After the modules are vertically stacked and mated, the rings 82 are welded together, as at 86, at their horizontal flanges 83 to provide a permanent watertight seal. By providing a flange configuration at the mating surfaces of the access trunks, a wide margin for misalignment during fabrication and mating of the modules can be tolerated. Any vertical gaps between the flanges is field fabricated to insure proper seal welding. The top deck 43 is sealed to the access trunk via an annular flange 81. A steel coaming and bolted hatch cover 85 are also installed at the top of the access trunk.

For pumping sea water into the storage facility for ballasting and displacement purposes, three separate salt water ballast pumps 66 are integrated along selected honeycomb cylinders in the outer row on the upper module. These form sumps located on the lee side of the storm waves. Their internal location in the honeycomb provides physical protection. In the presently preferred exemplary embodiment, pumps of approximately one meter diameter with a slightly larger entrance bell are used. These are conventional electric vertical drive pumps which extend through the top deck and are supported near the bottom of the upper module. An opening in the side wall of the facility at the entrance bell provides access for the sea water. Preferably, there is a galvanized or bronze perforated plate bolted or hinged to the opening and arranged so that the plate can either can be removed by divers or blanked off completely. The latter capability enables the sump to be dewatered for pump inspection or sump clean out. The pumps are bolted to the main deck 43 and vertically removable as a unit.

Similarly, two of the outer honeycomb cylinders 37 on the lee side of the upper module are utilized for salt water overboard discharging.

The storage facility uses an oil transfer and storage system of the salt water displacement type. The major constraint on the system is that both modules be kept pressed full of fluid at all times to insure maximum sliding resistance to environmental forces. In essence, salt water is pumped from the sea up to the main deck and down through the access trunks to each compartment. Hydraulically, the upper module compartments are operated essentially separately from the lower module compartments.

In operation, the pumping of salt water into the facility forces stored oil, which has a lower density than the seawater ballast fluid, out the top of the honeycomb to the access trunks and from there via suction to the shipping pumps. When filling with oil, the procedure is reversed so that oil is pumped into the tanks to force out salt water. The salt water effluent is monitored for oil carryover and then discharged overboard. A large capacity oil/water separator is not required; however, a small unit 87 is provided on the top deck for use during emergency or tank cleaning operations.

Figure 7:
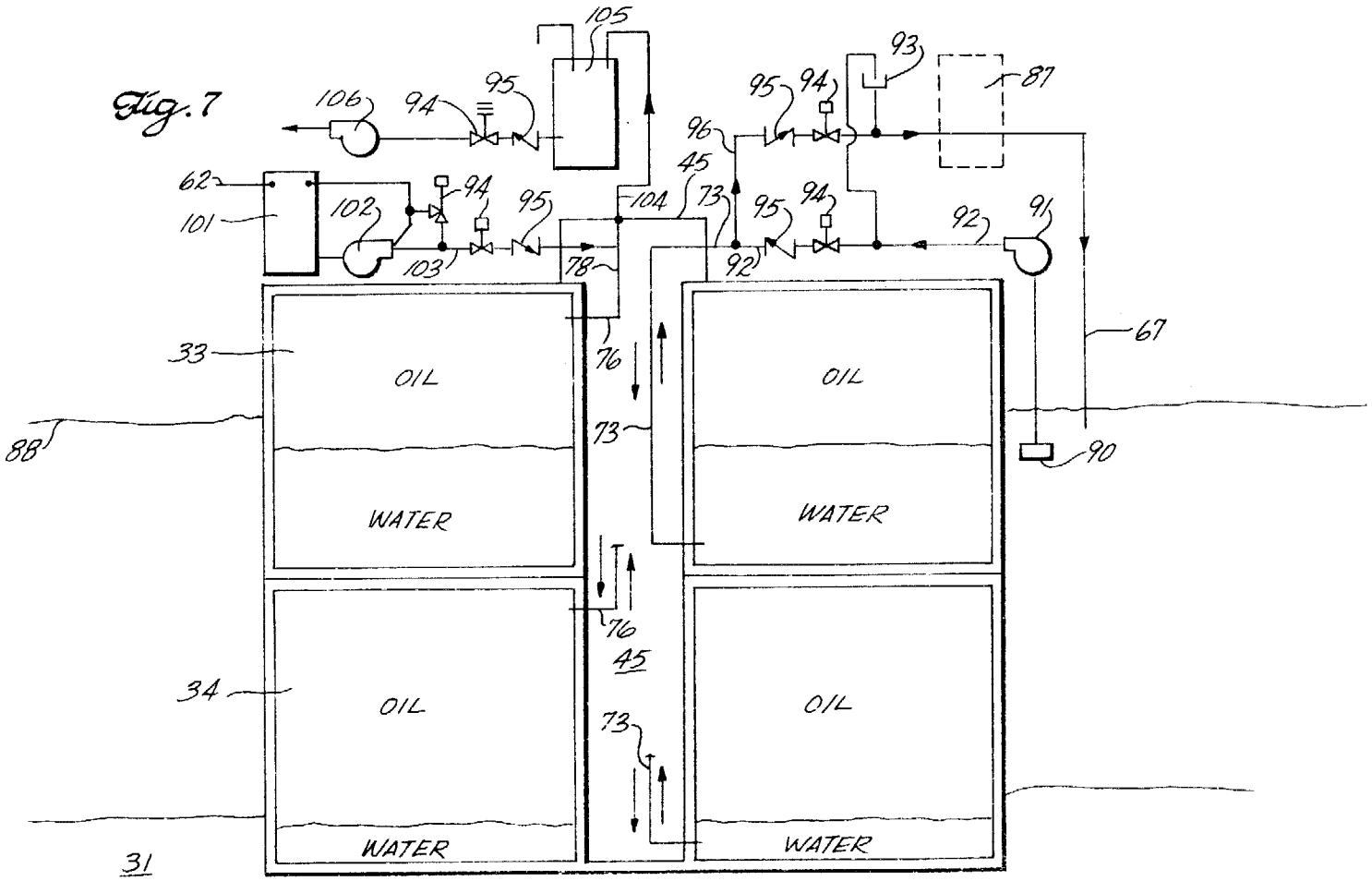
FIG. 7 is a schematic piping diagram illustrating the presently preferred arrangement for pumping oil and seawater into internal compartments of the structure.

FIG. 7 schematically illustrates the oil transfer and storage system. Only the major elements of the system and the cross connections are depicted. There are no penetrations of the outer shell of the stacked structure. All pipes from the cylinders are placed in the four access trunks and led to the main deck. Accordingly, assuming that the outer shell of the facility is not ruptured, any internal leakage will be contained within the access trunks. As the top deck is above the waterline 88 no leakage to the sea will occur. The oil storage and transfer system is designed to be failsafe at all times including electrical failures, mechanical failures and piping failures.

In FIG. 7, a seawater ballast pump 91 is in communication with a seawater inlet 90 and a seawater inlet line 92. The seawater inlet line leads into the seawater ballast line 73 into the access trunks and eventually into the honeycomb cylinders. The seawater ballast line 73 is connected both to seawater inlet line 92 and a seawater discharge line 96 which communicates with overboard discharges 67. Both the seawater inlet line 92 and the discharge line 96 include a check valve 94 and an adjustable flow valve 95. In operation, sea water is either pumped into a selected access trunk(s) through inlet line 92 or out through discharge line 96. The check valves 94 are alternately open or closed as needed. The rate of flow through either the inlet or discharge line is controlled by the adjustable flow valves 95. A head relief stand pipe 93 in communication with both the inlet and discharge lines establishes a maximum head that the salt water pumps can exert on the tanks.

The oil pumping system is conceptually similar in operation to the seawater ballasting system. Processed oil for storage from a stabilizing plant connected to a drilling facility or the like enters the storage facility at riser pipes 62. From there the oil enters a vented shipping surge tank 101 the function of which is to prevent inadvertant drawdown of the upper module compartments. The oil is pumped by fill pump 102 into oil inlet line 103 to oil line 78 entering the access trunks. From there the oil flows through lines 76 into the honeycomb cylinders.

The oil lines 78 are also in communication with an oil shipping line 104 which leads to a surge tank 105. From there, oil is pumped by a main shipping pump 106 into an ocean vessel or tanker, as appropriate, which preferably is located at the boat dock 64 on the lee side of the storage facility.

As with the sea water ballasting system, oil inlet line 103 and shipping line 104 include conventional check valves 94 and adjustable flow valves 95 to control the direction and magnitude of flow through the oil pumping system.

In normal operation, both modules' compartments are kept full of fluid at all times. This is accomplished by cooperatively pumping oil and forcing out sea water, or vice versa to keep the compartments full. However, the sea water level is never permitted to drop below a minimum height of four feet in any of the compartments. By maintaining the upper module full of fluid, the buoyancy of the facility is kept at a minimum. This increases the ability of the facility to resist sliding forces created by waves, earthquakes, collisions, or the like.

Figure 5:
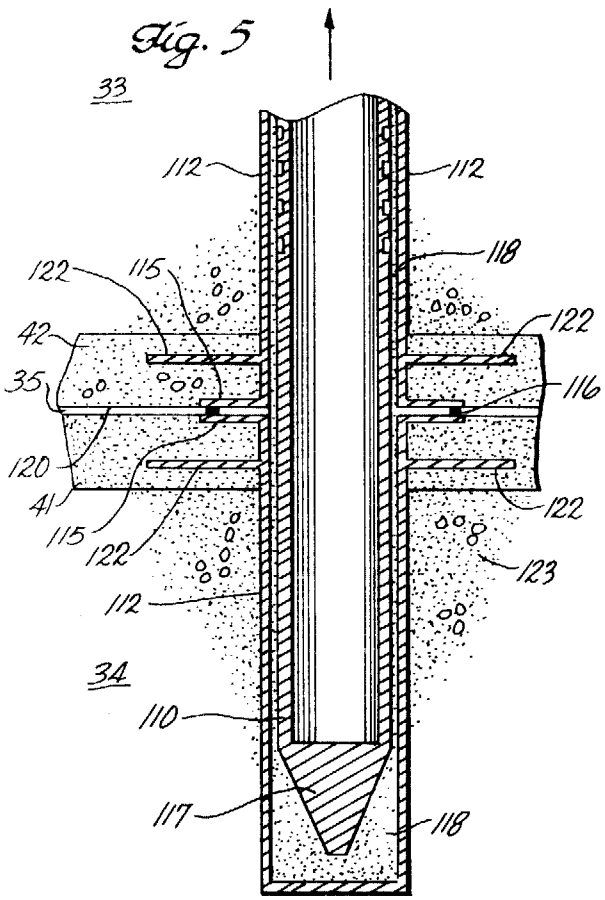
FIG. 5 is a cross-sectional elevation view of a shear pin for interconnecting modular subassemblies, according to this invention.

A series of shear pins 110, shown in cross section in FIG. 5, are installed during mating of the modules to provide both final alignment and mechanical shear resistance. There are eight shear pins per facility. During fabrication of the modules, eight 30 inch diameter steel pipes are cast into both the upper and lower modules to serve as guide tubes 112 for the shear pins. The arrangement of the guide tubes is such that when the modules are substantially but not fully mated one on top of the other the guide tubes will self-align as the tapered shear pins are inserted into the guide tubes. In the plan view of the upper module shown in FIG. 4, the eight locations of the guide tubes are shown at reference numeral 114. Four of the locations are on the internal tank boundary, while the remaining four are located somewhat outboard of each of the access trunks 45.

Each of the guide tubes includes a horizontal annular flange 115 at its mating surface. The flanges allow for strong grouting together of the guide tubes even with a small degree of misalignment.

When the modules are to be mated one on top of the other, a rubber O-ring 116 is glued to the deck of the lower module at the locations 114 prior to mating the modules so that as the upper module is installed, the O-ring is crushed and forms a dam around the guide tube. The shear/guide pins 110 are placed in the upper module guide tube in a raised position so that they do not project significantly below the lower edge of the guide tube. After the modules are initially aligned, the tapered shear/guide pins are lowered to provide the final alignment. This causes the guide tubes to self-align in the proper orientation for final mating of the modules. Accordingly the leading edge 117 of the shear pin is tapered to aid in final alignment. After the shear pins are in place, a strong grout 118, which preferably can be any conventional epoxy grout having a compressive strength of around 50,000 psi, is used to grout the shear pin to the guide tube. One such suitable epoxy type grout is available commercially under the trade designation "Chock Fast". After the shear pins are grouted and cured, the interface 35 between the modules is pressure grouted with ordinary cement grout 120.

To provide for maximum shear resistance, the shear pin is cylindrical with an outside diameter which substantially fills up the volume inside the guide tube. In the presently preferred exemplary embodiment, the shear pin is a 24" outside diameter pipe having a 3" wall thickness, while the guide tubes are 30" outside diameter steel pipes having also a 3" wall thickness. The rubber O-ring has a 3 foot diameter and is two inches thick. Also shown in FIG. 5 are steel flanges 122 welded to the guide tubes to provide structural integration of the guide tube to the concrete top and bottom slabs of the modules. In addition, a bulkhead 123 at the interface between the slab and the guide tube is reinforced.

Construction and Deployment Sequence

Figure 8:
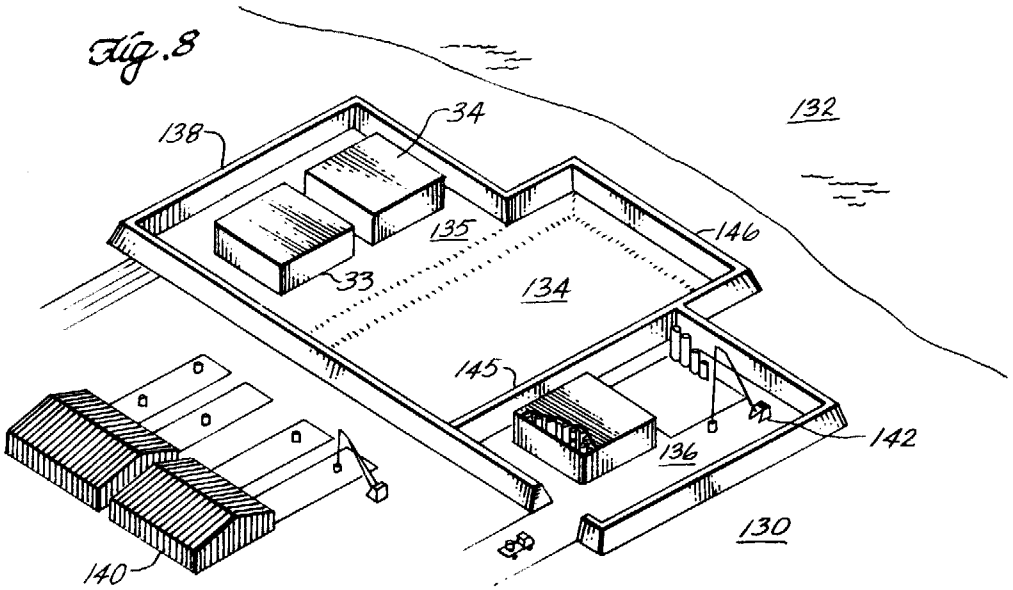
FIG. 8 is a simplified perspective view of an onshore construction site for fabricating modular subassemblies for use in the structure of FIG. 1.

The following procedures may be used for constructing and installing the storage facility 30. FIG. 8 schematically depicts a construction site 130 for fabricating and launching the presently preferred exemplary modules. The site is located on land with access to a river or a body of water 132 providing a minimum of 6 meters water depth and open to the ocean.

It is recommended that the construction site be located no more than about 20 meters inland from the water's edge, and extend inland approximately 430 meters and run parallel to the water for a distance of approximately 460 meters. The construction site includes a centrally located launch area 134 disposed between two module construction areas 135 and 136. A berm 138 runs around the perimeter of the construction and launch areas. That portion of the berm facing the body of water and enclosing launching area 134 is removable and is designated in FIG. 8 as launching berm 146. The berm 138 is constructed of sheet piles of about 15 meters long which are driven about 9 meters into the ground. Preferably the upper six meters of the berm is shored with earth excavated from launch area 134 which is excavated deeper than the construction areas.

The construction site 130 includes a complete fabrication facility to receive raw materials and produce completed concrete storage tank modules. Sand and gravel is delivered near a batch plant 140 located adjacent to the construction and launching area berm. Sack and bulk cement is stored under cover in an area near the batch plant. Preferably a rebar fabrication facility is located nearby the construction site to receive raw rebar and cut and bend the bar to the required shapes.

For facilitating construction, sufficient portable trunk cranes 142 are positioned inside the berm to handle and place forms, rebar, casting blocks and all the precast materials necessary to construct the modules. Earth moving equipment is used as needed for excavation in the launching area.

When a first set of tank modules 33, 34 have been completed in their construction area 135, a temporary berm 145 is erected to set off the other construction area 136 from the launching area 134. This allows flooding of the launch area and construction area 135 without flooding or otherwise interfering with operations in the other construction area 136. Thus, construction of a second set of modules can proceed during launching of the first set of modules.

Figure 9:
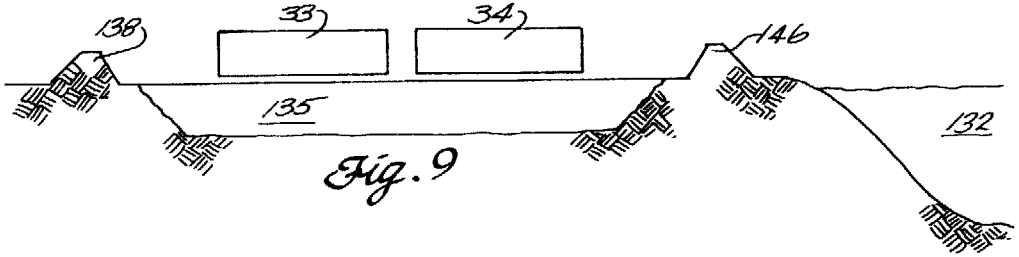

When the first set of modules is completed, water is pumped into the launching area 134 and into the construction area 135. In FIG. 9, prefabricated modules 33 and 34 are depicted in construction area 135.

Figure 10:
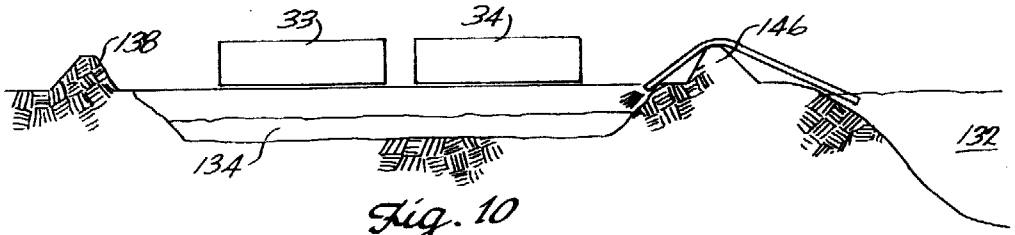
Figure 11:
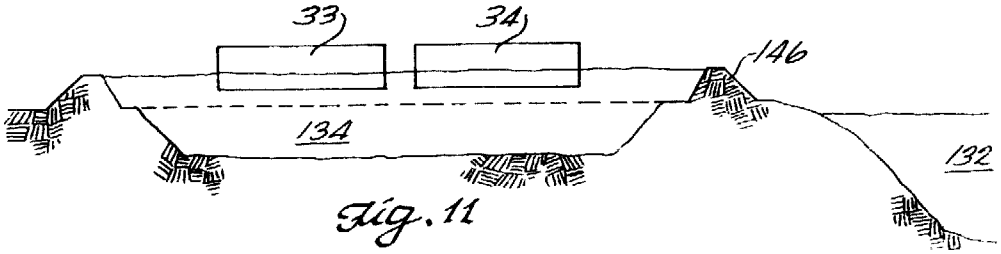

The launch sequence is depicted in FIGS. 9–14. During the first step, water is pumped into the launching area 134 and into the appropriate construction area 135. This requires approximately 6 meters of water above the bottom in the construction area to float the completed tank modules. In FIG. 10, this process is shown schematically where water from channel 132 is pumped into the launching area 134. In FIG. 11, sufficient water has been pumped into the area 135 to float the modules, and they have been moved into the lower launch area 134. The construction area has been previously excavated to a depth of about 6 to 8 feet below the local water line defined by channel 132 so that, with the water line at the level of channel 132, the construction area has a sufficient depth to float the completed tank modules 33 and 34 in it.

Figure 12:
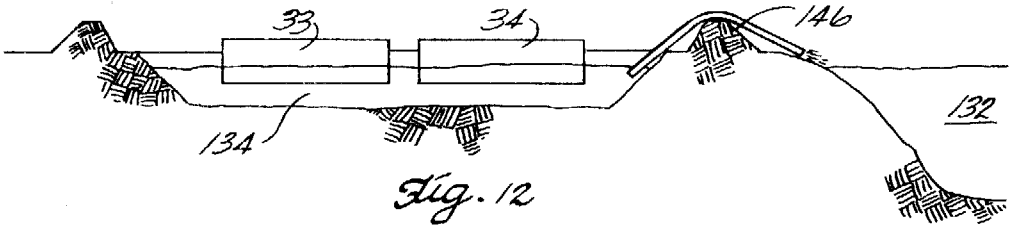
Figure 13:
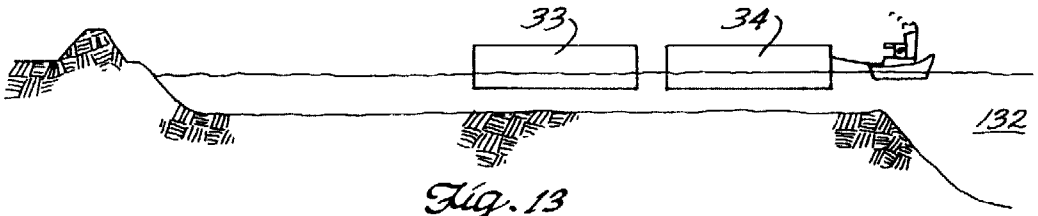
Figure 14:
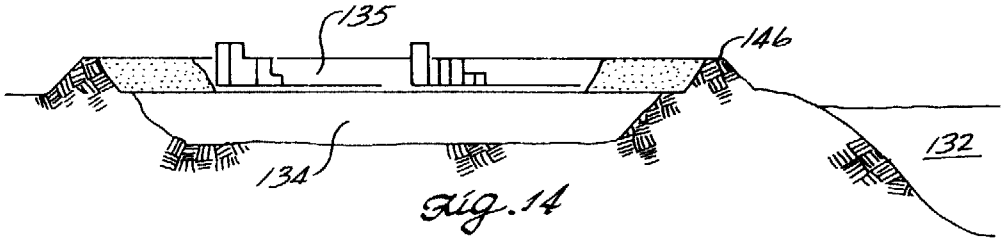

In FIG. 12, water is drained from the construction site to access channel 132 to equalize the water level between these two bodies of water, while modules 33,34 float in the construction area. When the water inside the launching area is at the same level as the harbor or water access channel 132, the launching berm 146 is removed and the area between launch area 134 and channel 132 is excavated to allow the two completed modules 33,34 to be towed into the channel, as depicted in FIG. 13. After tow out of the modules, the launching berm 146 is replaced and the launching area is dewatered. The temporary berm 145 separating the second set of two tank modules in the set off construction area 136 is removed and relocated to the opposite site of the launching excavation to enclose construction area 135. This permits continuing construction of a third pair of modules while preparations are being made for launching of the second set of modules. This procedure is repeated as desired until all needed sets of tank modules are completed and launched. In the presently preferred practice of this invention, at least four sets of tank modules are so constructed.

Figure 15:
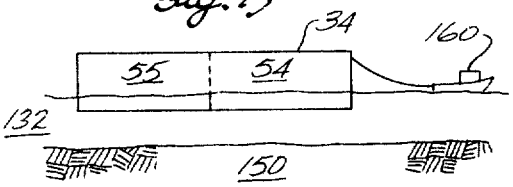

FIG. 15 depicts towing of lower module 34 along channel 132 to a selected module mating site 150. This site should have a 20 meter minimum to 26 meter maximum depth with smooth bottom conditions and calm protected waters. Preferably this site is located inside a protected harbor.

Figure 16:
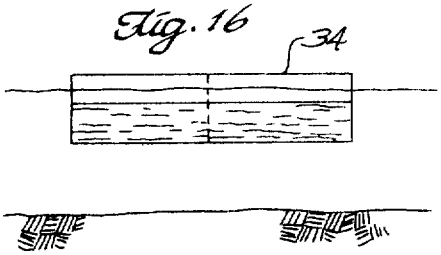
Figure 17:
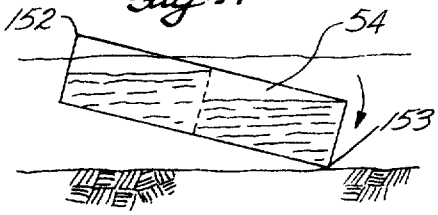
Figure 18:
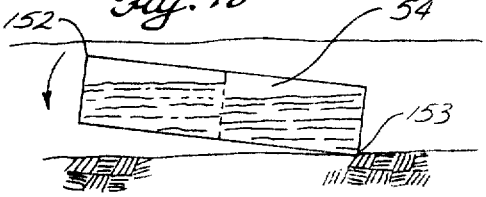
Figure 19:
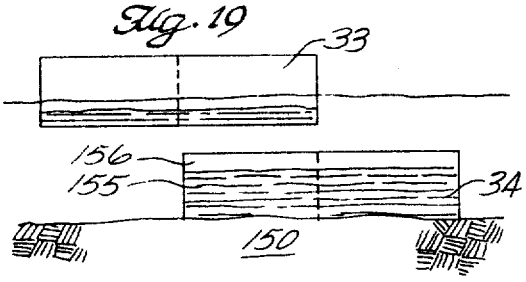

In FIG. 16, the lower module 34 is flooded through the bottom of the access trunks by means of the sea valve 70 and the pair of tank drain valves 71. Venting is accomplished through oil shipping line 78. The lower module is flooded evenly to a draft of approximately 34 feet as shown in FIG. 16. The forward compartments only are then flooded to trim the module downward and rest the forward end on the bottom, as depicted in FIG. 17. The valves are then closed. The floating aft end 152 provides water plane for static stability during descent of the forward end 153. The aft compartments are then flooded (FIG. 18) with the forward edge resting on the bottom to provide stability during descent of the aft end until the lower module is made to rest on the harbor floor. However, during this operation the lower module is not completely ballasted so that the bearing load on the bottom is minimized. This is shown schematically in FIG. 19, where module 34 is shown mostly ballasted with a flooded portion 155 and an unflooded portion 156. An upper module 33 is also depicted being brought into position over lower module 34.

The upper module 33 is positioned over the top of the lower module using conventional methods, such as a four point anchoring spread. The upper module is then ballasted down by opening the tank drain valves in the access trunks. With the upper module about two feet above the lower module, the moorings are adjusted to position the module to within one foot of the proper position. Four sets of shear pin guide tubes 112 are then lowered into position to serve as guide posts. Once the sleeves are in their respective sockets the module is further ballasted until contact is made with the lower module. A predetermined pressure between the modules is then maintained by selective further ballasting of the upper module.

Figure 20:
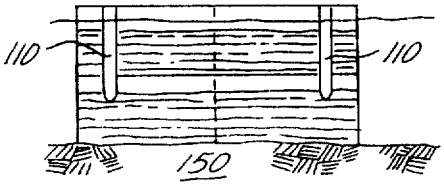

All eight shear pins 110 are then lowered into the sockets in the lower module and grouted in place with a high strength epoxy material, as depicted in FIG. 20. The sea drain valves are closed and a submersible dewatering pump is then lowered into each access trunk for deballasting both the upper and lower modules. Control of ballasting is achieved by means of the tank drain valves 71 allowing water to flow into the access trunk for evacuation by the submersible pump.

Figure 21:
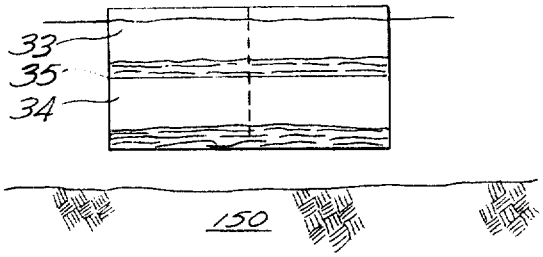

FIG. 21 depicts deballasting of the modules. During this procedure, the module interface is always kept in positive contact by sequentially deballasting the modules while always keeping the upper module more full of fluid than the lower module. The modules are deballasted until their interface 35 is at or above the water surface, at which time the upper module is deballasted completely to bring the interface above the water line. The interface is then pressure grouted using ordinary cement. The ballast and oil shipping piping manifold, the valve controllers and appropriate instrumentation are permanently connected. Finally, the access trunks are seal welded to complete the mating of the upper and lower modules.

Figure 22:
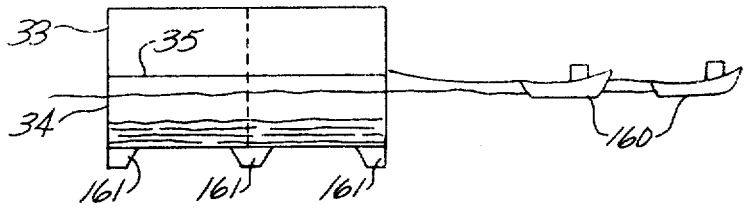

FIG. 22 depicts towing of a mated facility 30 from the mating site to the deep water installation site. For towing from the mating site to the operating site, the upper module is kept dry and the lower module is ballasted until the interface between the modules is about six feet above water line. The mated modules displace about 90,000 to about 100,000 metric tons with a draft of about 40 feet. It is presently preferred to tow the tank diagonally using two tugs 160. In this manner, a tow of approximately 240 nautical miles can be completed in about three days.

It is assumed that the water depth at the installation site is at an average of about 18 meters with a coraliferous substrata having a sand overburden. These characteristics are sufficient to support the stacked structure with a maximum bearing pressure of about 20 $mt/m^2$ and provide sufficient sliding resistance.

Figure 23:
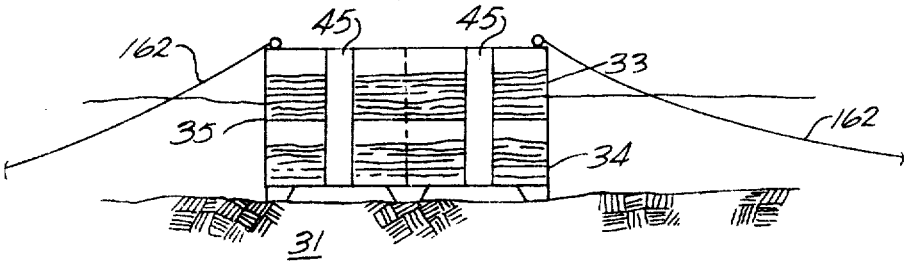

Once the stacked structure 30 is on station, any one of several methods can be used to position it over the prepared site. It is presently preferred to employ a multiplicity of anchors 162 and wire rope winches. The facility is lowered to the seabed by ballasting the modules. This is done by sequentially pumping into, but not flooding, both the upper and lower modules so that a firm compressive force is maintained at the module interface 35. By pumping into the tanks, rather than permitting free flooding, exact control of descent rate can be maintained. This process is depicted schematically in FIG. 23.

Figure 24:
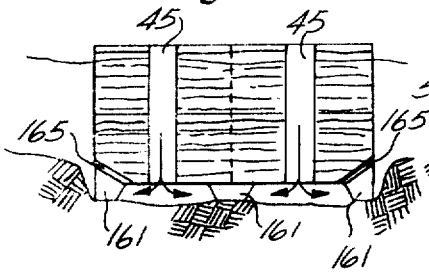
Figure 25:
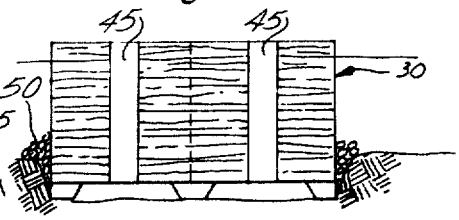

In FIG. 24, the assembly is on the bottom and all compartments are pressed full so that maximum load is applied on the skirts 161 contacting the seabed. Grouting between the bottom of the structure and the ocean floor is accomplished through the access trunks. Any space between the sea bed and the bottom of the structure is grouted by pumping through the preinstalled piping in the access trunk and naturally venting through the vent ducts 165 cast into the bottom slab. The perimeter of the tank is backfilled with various grades of filter cloth, gravel, rock and boulders shown at reference numeral 50 in FIG. 25 to prevent scouring. The oil riser pipes and pumps are connected to supply lines from a nearby oil drilling or producing facility, and appropriate pumping and control systems are connected to bring the storage facility 30 on line. During operation of the facility 30, both tank modules are kept pressed full of fluid at all times to maintain a selected pressure at interface 35 and on the seabed. This provides maximum shear resistance and keeps the overturning moment of the facility as low as possible.

The particular details of the stacked concrete structure, and the procedures for its installation have been described in the context of the presently preferred embodiment, which has particular utility as a liquid (oil) storage facility for use in conjunction with offshore oil exploration. It will be appreciated, however, that the stacked concrete structure 30 possesses utility as a breakwater or a tank farm or even as a parcel of real estate in a marine environment. It will also be appreciated that, once installed, an operational facility can be deballasted, refloated, and moved to a second installation site, if desired. It should also be apparent that a stacked structure can comprise more than two vertically stacked subassemblies; for example, three or four subassemblies can be stacked vertically, using the structures and procedures described above, to form a unitary structure. Moreover, it will be appreciated that the module stacking procedure described above can be used to vertically assemble, in water of appropriate depth, a plurality of relatively small modules of similar or dissimilar nature and construction to define a large overall offshore structure which can be installed in waters shallower than those needed for full mating of the several modules, thus to provide an overall structure which has high contact pressure with a sea floor, with the uppermost units high and dry and safe from water or ice or collision forces, and the lower units having sufficient strength to resist such forces. Such an overall structure can be used as an offshore drilling island in Arctic waters where the high contact pressure is useful to enable the island to resist and stand against lateral forces, such as from ice, tending to move the drilling island from its initial position on the sea floor.

Accordingly, the foregoing description is not intended as restricting this invention to the practice of only the structures, procedures, and uses described. Rather this description is intended as illustrative and exemplary and it is intended that the following claims will be interpreted in that spirit.

What is claimed is:

1. A concrete offshore structure located in water of selected depth and extending from a surface defining the bottom of the water body to above the water surface and comprising at least two similar prefabricated concrete modular subassemblies interconnected in a vertical arrangement in such manner to define a horizontal interface between each such pair of subassemblies,, vertical guide tubes cooperatively disposed in each of said subassemblies, said guide tubes adapted to at least partially register with one another when said subassemblies are vertically arranged, a shear pin adapted to be received by said cooperating guide tubes to prevent relative movement between said subassemblies, said shear pin having a leading edge to positively align said cooperating guide tubes and thereby said subassemblies when received into said guide tubes, and cement between each such pair at each interface for securing the members of each pair together.

2. A concrete offshore structure according to claim 1 wherein each subassembly defines at least one liquid storage tank, and further comprising stored liquid and water piping means to each tank arranged for supplying stored liquid and water to the tanks to maintain selected tanks filled with liquid.

3. A concrete offshore structure according to claim 2 wherein the liquid storage tank comprises a plurality of substantially parallel vertical cylinders.

4. A concrete offshore structure according to claim 1 wherein the internal volume of each subassembly comprises a plurality of substantially parallel vertical cylinders interconnected by a plurality of vertical walls.

5. A concrete offshore structure according to claim 2 wherein there are four liquid storage tanks in each subassembly.

6. A concrete offshore structure according to claim 2 wherein the stored liquid and water piping means associated with each tank is operable hydraulically separately from the stored liquid and water piping means associated with the remaining tanks.

7. A concrete offshore structure according to claim 2 wherein the at least one liquid storage tank associated with each of said vertically arranged subassemblies in the offshore structure is kept essentially full of fluid during substantially all phases of operation.

8. A concrete offshore structure according to claim 4 wherein at least one vertical cylinder in one subassembly and a vertical cylinder in the other of said subassemblies cooperate to define an access trunk when said subassemblies are aligned, a portion of the stored liquid and water piping means associated with each liquid storage tank is disposed in the interior of said access trunk.

9. A concrete offshore structure according to claim 8 wherein each such access trunk is disposed centrally of its associated liquid storage tank.

10. A method for deploying a concrete offshore structure at a selected location in a body of water of selected depth to extend from a bed defining the bottom of the water body to above the water surface, the structure when assembled being comprised of two similar prefabricated concrete modular subassemblies interconnected in a vertical arrangement in such manner to define a horizontal interface between such pair of subassemblies, the method comprising:

(a) floating such pair of subassemblies separately and individually in a channel of water having access to the selected assembly location;

(b) positioning a first modular subassembly of such pair while floating over a selected place of assembly located in water of a selected depth greater than the height of the subassembly;

(c) ballasting the first modular subassembly sufficiently to submerge it to contact the bed defining the bottom of the water body at the place of assembly, wherein substantially all of the lower surface of the first modular subassembly contacts the bed;

(d) positioning a second modular subassembly of such pair floating over the submerged first subassembly at the place of assembly;

(e) ballasting the second modular subassembly sufficiently to lower it proximate to the first subassembly;

(f) disposing a plurality of rigid shear resistant pins between the first and the second subassemblies to bring them into essential vertical alignment, thereby defining a horizontal interface between the subassemblies;

(g) further ballasting the second subassembly to contact the subassemblies along essentially all of their horizontal interface;

(h) deballasting the subassemblies sufficiently to bring the horizontal interface above the surface of the water while maintaining intimate contact of the subassemblies along the interface;

(i) securing the subassemblies together to form a unitary floating structure; and (j) ballasting the structure sufficiently to bring essentially all of its bottom surface into contact with the bed defining the bottom of the water body, whereby the structure is deployed.

11. A method according to claim 10 wherein the location where the structure is deployed in step (j) is removed from the selected place where the structure is assembled during steps (b) through (i), and further comprising between steps (i) and (j), the step of transporting the floating structure from the place of assembly to a selected place of deployment in water of a selected depth which is less than the vertical dimension of the structure.

12. A method according to claim 10 wherein the offshore structure is relocated after initial deployment, and further comprising, after step (j):

(k) deballasting the structure sufficiently to float it while maintaining the horizontal interface in intimate essential contact;

(l) transporting the floating structure to a second selected place of deployment in water of selected depth; and (m) repeating step (j) to deploy the structure at the second place of deployment while maintaining said intimate essential contact.

13. A concrete offshore structure according to claim 1 wherein the uppermost of said vertically arranged subassemblies has at least one wall arranged to face the prevailing direction of severe weather conditions, said uppermost subassembly having a sand filled compartment adjacent to and reinforcing said one wall.

* * * * *

UNITED STATES PATENT AND TRADEMARK OFFICE

CERTIFICATE OF CORRECTION

PATENT NO. : 4,422,803

DATED : December 27, 1983

INVENTOR(S) : Sherman B. Wetmore

It is certified that error appears in the above—identified patent and that said Letters Patent is hereby corrected as shown below:

On the Title Page, Item [73], for "Global Marin, Inc." read -- Global Marine Inc. --

Signed and Sealed this

*Fifteenth* Day of *January 1985*

[SEAL]

*Attest:*

*Attesting Officer*

GERALD J. MOSSINGHOFF

*Commissioner of Patents and Trademarks*